US007588433B2

(12) United States Patent
Kishi et al.

(10) Patent No.: US 7,588,433 B2
(45) Date of Patent: Sep. 15, 2009

(54) VANE PUMP

(75) Inventors: Yoshinobu Kishi, Toyota (JP); Kikuji Hayashida, Toyota (JP); Kiyotaka Ohtahara, Toyota (JP)

(73) Assignee: Taiho Kogyo Co., Ltd., Toyota-shi, Aichi (JP)

( * ) Notice: Subject to any disclaimer, the term of this patent is extended or adjusted under 35 U.S.C. 154(b) by 16 days.

(21) Appl. No.: 11/884,217

(22) PCT Filed: Jan. 31, 2006

(86) PCT No.: PCT/JP2006/301555

§ 371 (c)(1),
(2), (4) Date: Aug. 10, 2007

(87) PCT Pub. No.: WO2006/087904

PCT Pub. Date: Aug. 24, 2006

(65) Prior Publication Data

US 2008/0159896 A1 Jul. 3, 2008

(30) Foreign Application Priority Data

Feb. 16, 2005 (JP) ..... 2005-039643

(51) Int. Cl.
*F03C 2/00* (2006.01)
*F03C 4/00* (2006.01)
*F04C 2/00* (2006.01)

(52) U.S. Cl. ..... 418/255; 418/76; 418/81; 418/112; 418/145

(58) Field of Classification Search ..... 418/75, 418/76, 81, 104, 112, 145–148, 253, 255
See application file for complete search history.

(56) References Cited

U.S. PATENT DOCUMENTS 3,499,600 A * 3/1970 McGregor ..... 418/88

FOREIGN PATENT DOCUMENTS

| | | | | |
|---|---|---|---|---|
| DE | 3619166 A1 * | 12/1986 | ..... | 418/253 |
| DE | 3734573 A1 * | 4/1988 | ..... | 418/255 |
| JP | 05-149282 | 6/1993 | | |
| JP | 11-062864 | 3/1999 | | |
| JP | 2004-011421 | 1/2004 | | |
| JP | 2004263690 A * | 9/2004 | | |

* cited by examiner

*Primary Examiner*—Theresa Trieu
(74) *Attorney, Agent, or Firm*—Flynn, Thiel, Boutell & Tanis, P.C.

(57) ABSTRACT

A vane pump comprising a housing, a rotor and a vane is provided. The housing comprises a pump room having an approximately circular inner wall. The rotor rotates at an eccentric position relative to a center of the pump room and slides in contact with a part of the inner wall of the pump room. The vane is rotated by the rotor, for dividing the pump room into a plurality of spaces full-time. In the housing, among spaces divided by a center line drawn between the center of the pump room and a center of rotation of the rotor, an intake passage in one space and an exhaust passage in the other space are formed, respectively. An oil supply passage is formed in the rotor and the housing. A lubricating oil is intermittently fed through a communicating hole of the oil supply passage.

5 Claims, 2 Drawing Sheets

VANE PUMP

FIELD OF THE INVENTION

The present invention relates to a vane pump, and in particular to a vane pump adapted to intermittently feed a lubricating oil to a pump room owing to rotation of a rotor.

BACKGROUND ART

A conventional vane pump includes a housing having a pump room in which an approximately circular, inner wall is formed; a rotor rotating at an eccentric position relative to the center of the pump room and sliding in contact with a part of the inner wall of the pump room; and a vane rotated by the rotor, for dividing the pump room into a plurality of spaces full-time.

In the rotor and the housing, an oil supply passage intermittently communicating with a pump room owing to rotation of the rotor is formed. A lubricating oil is intermittently fed through a communicating hole of the oil supply passage formed in the pump room. The communicating hole is formed at a position on the side of an intake passage from a center line drawn between the center of the pump room and the center of rotation of the rotor in the housing.

SUMMARY OF THE INVENTION

The lubricating oil has, in addition to an effect of lubricating the vane and the pump room, an effect of sealing a gap between the vane and the pump room to maintain airtight of a space divided by the vane. When the lubricating oil is not sufficiently fed into the pump room, such as at the time of engine start, the sealing is not fully effected.

In the case of the conventional vane pump, the communicating hole is formed at a position on the side of the intake passage from the center line. Thus, even if the vane passes the communicating hole, a pressure in the space divided by the vane becomes negative, and so the lubricating oil is made to flow into the pump room only in a manner that the lubricating oil is dragged to the rotational direction of the vane.

Therefore, it takes a considerable time until the lubricating oil is fed between the vane and the pump room, and sealing the gap between the vane and the pump room is fully effected. There also arose a problem that, during this time period, the vane pump cannot fulfill its original performance.

In view of such problems, an object of the present invention is to provide a vane pump which can rapidly exert its original performance, even when the amount of the lubricating oil fed to a pump room is small, such as at the time of engine start.

The vane pump according to the present invention comprises: a housing having a pump room, the pump room having an approximately circular inner wall; a rotor rotating at an eccentric position relative to a center of the pump room and sliding in contact with a part of the inner wall of the pump room; and a vane rotated by the rotor, for dividing the pump room into a plurality of spaces full-time. In the housing, among spaces divided by a center line drawn between the center of the pump room and a center of rotation of the rotor, an intake passage in one space and an exhaust passage in the other space are formed, respectively. In the rotor and the housing, an oil supply passage intermittently communicating with the pump room owing to the rotation of the rotor is formed. A lubricating oil is intermittently fed through a communicating hole of the oil supply passage formed in the pump room, and the communicating hole is formed in a space on a side of the exhaust passage from a center line in the pump room. The vane passes the communicating hole at the same time when the oil supply passage and the pump room are adapted to communicate with each other.

According to the present invention, when the vane passes the exhaust passage, the pump room is divided into three spaces by the vane. Among them, the space on the side where the rotor contacts with the pump room is divided into a space on the side of the intake passage and a space on the side of the exhaust passage relative to the center line by the rotor.

At this time, the pressure in the space on the side of the intake passage from the center line, the side where the rotor contacts with the pump room, is made negative due to suction of a gas through the intake passage. The pressure in the space on the side where the rotor does not contact with the pump room is made negative, because its volume is increased by the rotation of the vane.

Further, the space on the side of the exhaust passage from the center line, the side where the rotor contacts with the pump room, has higher pressure than the space in which the pressure is negative due to increase of the volume as described above. While its volume is decreased, the lubricating oil and the gas are discharged from the exhaust passage.

In such a manner, even when the vane passes the communicating hole after it passes the exhaust passage, the differential pressure between the space having the negative pressure due to increase of the volume and the space having the higher pressure than the relevant space is also generated, and thus the lubricating oil in the space having the higher pressure is spouted into the space having the negative pressure through a gap between the vane and the pump room.

The lubricating oil spouted into the space having the negative pressure is spouted in the direction opposite to the rotational direction of the vane, so that the lubricating oil positively impact on the vane which subsequently passes the communicating hole.

As a result, the spouted lubricating oil seals the gap between the vane and the pump room, and accordingly the vane pump can rapidly exert its original performance, even if the lubricating oil is not sufficiently fed into the pump room.

DETAILED DESCRIPTION

Figure 1:
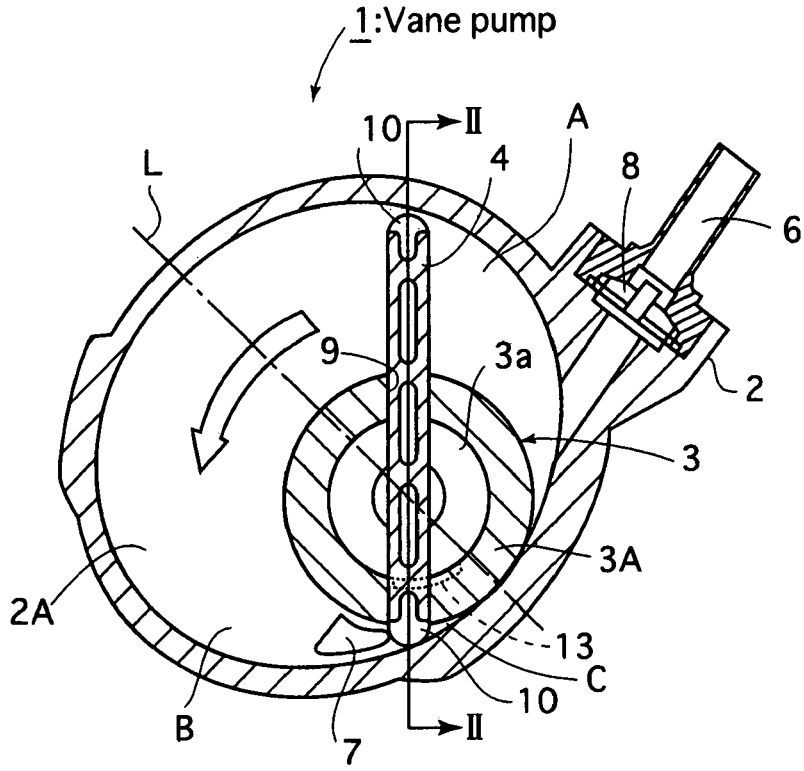
FIG. 1 is an elevational view of a vane pump.
Figure 2:
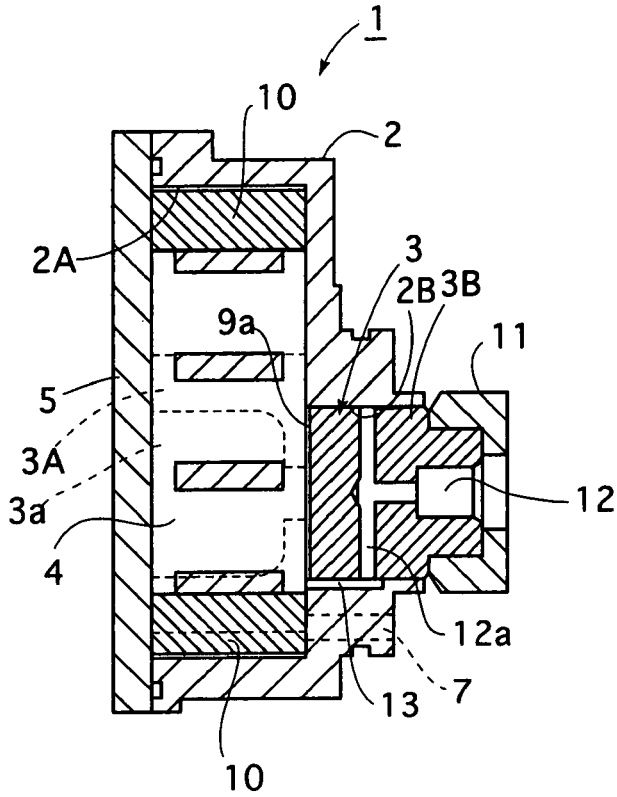
FIG. 2 is a cross-sectional view taken along the line II-II in FIG. 1.
Figure 3:
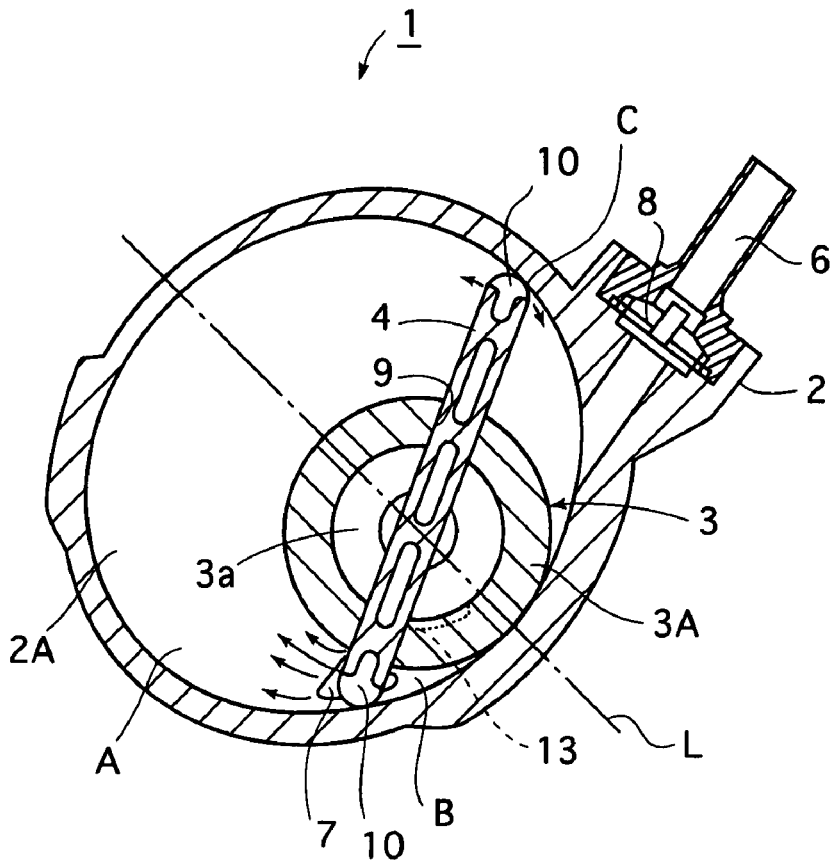
FIG. 3 is an elevational view of the vane pump showing a situation that a vane moves from FIG. 1.

An embodiment of the present invention will be described hereinafter. FIGS. 1 to 3 show a vane pump 1 of this embodiment. The vane pump 1 is fixed on the side surface of an engine of an automobile, and adapted to generate the negative pressure in a booster of a brake control system.

The vane pump 1 includes: a housing 2 having an approximately circular pump room 2A formed therein; a rotor 3 rotated at an eccentric position relative to the center of the pump room 2A by a driving force of the engine; a hollow vane 4 rotated by the rotor 3, for dividing the pump room 2A into a plurality of spaces full-time; and a cover 5 for covering the pump room 2A.

In the housing 2, an intake passage 6 located above the pump room 2A, in communication with the booster of the brake control system, for sucking in a gas from the booster, and an exhaust passage 7 located below the pump room 2A, for discharging the gas sucked in from the booster and a lubricating oil fed from an oil supply groove 13 are provided, respectively. In the intake passage 6, a check valve 8 is provided to hold the negative pressure in the booster, especially at stop of the engine.

The rotor 3 includes a cylindrical rotor portion 3A rotating in the pump room 2A, and an outer surface of the rotor portion 3A contacts with an inner wall surface of the pump room 2A. The intake passage 6 and the exhaust passage 7 are disposed oppositely across a center line L drawn between the center of the rotor portion 3A and the center of the pump room 2A.

The rotor 3 is arranged to rotate counterclockwise. In the following description, an upstream side in the rotational direction means a space adjacent to a clockwise side from a line drawn between the center of rotation of the rotor 3 and an arbitrary point of the pump room 2A, and a downstream side in the rotational direction means a space adjacent to a counterclockwise side from the line.

Further, in a central portion of the rotor portion 3A, a hollow portion 3*a* and a groove 9 in the diametrical direction are provided, and the vane 4 is adapted to move slidably along in the groove 9 in the direction perpendicular to the axial direction of the rotor 3.

Moreover, on both ends of the vane 4, caps 10 of which fore ends are formed to be semicircular are provided. The fore ends of the caps 10 slides in contact with the inner wall surface of the pump room 2A, and a slight gap is present between the vane 4 and the caps 10.

To the pump room 2A, the lubricating oil is arranged to be fed through an oil supply groove 13, and a communicating hole of the oil supply groove 13 is formed on the downstream side in the rotational direction of the vane 4 from a position at which the exhaust passage 7 is formed.

Therefore, the vane 4 is arranged to pass the oil supply groove 13 after passing the exhaust passage 7, so that the lubricating oil fed from the oil supply groove 13 is not discharged, just as it is, from the exhaust passage 7.

In addition, as shown in FIG. 1, the vane 4 is shown as oriented in the vertical direction. Hereinafter for illustrative purposes, a space situated on the right side shown of the vane 4 and above the rotor portion 3A in the pump room 2A is called the "first space A", a space situated on the left side of the vane 4 is called the "second space B" and a space situated on the right side of the vane 4 and below the rotor portion 3A is called the "third space C".

FIG. 2 shows a cross-sectional view taken along the line II-II in situations shown in FIG. 1. In the housing 2, a bearing 2B adjacent to the pump room 2A for supporting the rotor 3 is formed, and the cover 5 is provided on the opposite side to the bearing 2B.

The rotor 3 includes a shank 3B supported by the bearing 2B, for driving rotationally the rotor portion 3A. The shank 3B projects from the bearing 2B to the right side and is linked to a coupling 11 driven rotationally by a camshaft of the engine.

End surfaces of the rotor portion 3A and the vane 4 on the left side slide in contact with the cover 5, and an end surface of the vane 4 on the right side rotates slidably in contact with an inner surface of the pump room 2A on the side of the bearing 2B.

Moreover, a bottom surface 9*a* of the groove 9 formed in the rotor 3 is formed on the side of the shank 3B slightly from a surface on which the vane 4 and the pump room 2A slide, and a gap between the vane 4 and the bottom surface 9*a* is present.

In the shank 3B, specifically in its central portion, an oil passage 12 for circulating the lubricating oil from the engine and constituting an oil supply passage is formed, and this oil passage 12 branches at a predetermined position in the same direction as the groove 9 and includes a branch passage 12*a* open into an outer surface of the shank 3B.

Further, in the bearing 2B, an oil supply groove 13 formed in the axial direction of the bearing 2B, for constituting the oil supply passage forming the communicating hole into the pump room 2A, is formed. As shown in FIG. 1, a width of the oil supply groove 13 along the rotational direction of the vane 4 is not smaller than that of the vane 4.

Owing to such a configuration, when the branch passage 12*a* coincides with the oil supply groove 13 due to rotation of the rotor 3, the lubricating oil from the oil passage 12 flows into the pump room 2A through the oil supply groove 13, and approximately half of the lubricating oil is arranged to flow into the hollow portion 3*a* of the rotor 3 from the gap between the vane 4 and the bottom surface 9*a* of the groove 9.

Further, the rest of the lubricating oil is arranged to be sucked down into the pump room 2A of which pressure becomes negative due to rotation of the vane 4, being sprayed into the pump room 2A through the gap between the vane 4 and the bottom surface 9*a* of the groove 9 or the gap between the vane 4 and the cap 10.

With the configuration described above, the operation of the vane pump 1 according to this embodiment will be described. The rotor 3 is rotated counterclockwise as shown in FIG. 1 by the operation of the engine through the coupling 11, and then the vane 4 rotates while reciprocating in the groove 9 of the rotor 3. The space divided by the vane 4 in the pump room 2A changes in volume depending on rotation of the rotor 3.

FIG. 3 shows a situation when the vane 4 is passing the oil supply groove 13 due to the rotation of the rotor 3.

The first space A in FIG. 1 is located on the left side of the vane 4 in FIG. 3 due to the rotation of the rotor 3, and the second space B in FIG. 1 is located on the right lower side of the vane 4 and the rotor 3 in FIG. 3.

The first space A has an increased volume compared to that in FIG. 1, and further sucked the gas from the booster through the intake passage 6. Accordingly, the pressure in the first space A becomes negative.

On the one hand, the volume of the second space B is decreased compared to that in FIG. 1. The lubricating oil along with the gas in the second space B is also discharged from the exhaust passage 7, at this time, in order to force the lubricating oil in the exhaust passage 7 to be removed. The gas in the second space B is compressed to have the higher pressure than the gas in the first space A.

During the change from FIG. 1 to FIG. 3, the differential pressure between the first space A and the second space B is generated. As a result, the lubricating oil which could not be removed through the exhaust passage 7 by the vane 4 is sprayed into the first space A through the gap between the pump room 2A and the vane 4, and through the gap between the vane 4 and the cap 10, respectively, due to the differential pressure.

Further, in FIG. 3, the branch passage 12*a* in the oil supply passage and the groove 9 of the rotor 3 are placed in the same direction, if the vane 4 and the oil supply groove 13 coincide with each other in position as shown, at the same time, the branch passage 12*a* and the oil supply groove 13 also coincide with each other.

In this manner, when the branch passage 12*a* and the oil supply groove 13 coincide with each other, approximately half of the lubricating oil from the oil supply groove 13 flows into the hollow portion 3*a* of the rotor 3 through the gap between the vane 4 and the bottom surface 9*a* of the groove 9.

Subsequently, this lubricating oil goes up in the manner of flowing along an inner surface of the rotor due to a centrifugal force by the rotor 3, and seals the gap between the cover 5, the rotor 3 and the vane 4.

On the other hand, as for the rest of the lubricating oil, because the oil supply groove 13 is formed on the downstream side, the lubricating oil from the oil supply groove 13 is made misty to be spouted into the first space A through a bottom portion of the rotor portion 3A downstream, due to the negative pressure in the first space A.

That is, in this embodiment, to the first space A, the lubricating oil is adapted to be fed at two steps, first being sprayed from the second space B as described above, and then being sprayed from the bottom portion of the rotor portion 3A downstream.

Further, each of the lubricating oil spouted into the first space A through the gap between the bottom surface of the rotor portion 3A and the bottom surface of the pump room 2A, the lubricating oil through the gap between the vane 4, the groove 9 and the bottom surface 9*a*, and the lubricating oil through the gap between the vane 4 and the cap 10, is spouted in the direction opposite to the rotational direction of the vane 4.

Therefore, against the vane 4 which, subsequently, reaches the exhaust passage 7 due to the rotation of the rotor 3, the lubricating oil is blown, and the lubricating oil gets into the gap between the vane 4 and the pump room 2A, and the gap between the cap 10 and the pump room 2A.

By spouting the lubricating oil positively in the direction opposite to the rotational direction of the vane 4, the lubricating oil can rapidly circulate around in the gap between the vane 4 and the pump room 2A or the gap between the cap 10 and the pump room 2A, when the lubricating oil is not sufficiently distributed in the vane pump 1, especially such as at start of the engine.

Then, the lubricating oil not only lubricates the inside of the vane pump 1, but plays a role of sealing. By sealing the gap between the vane 4 and the pump room 2A etc. with the lubricating oil, the gap between the second space B and the first space A can be held airtight.

Therefore, even immediately after the start of an engine, the vane pump 1 can rapidly exert its original performance.

On the contrary, in the conventional vane pump, because the direction in which the lubricating oil flows is a direction following the rotation of a vane, the gap between the cap and the pump room is not rapidly sealed. Thus, immediately after the engine gets started, the vane pump cannot rapidly exert its original performance.

Figure 4:
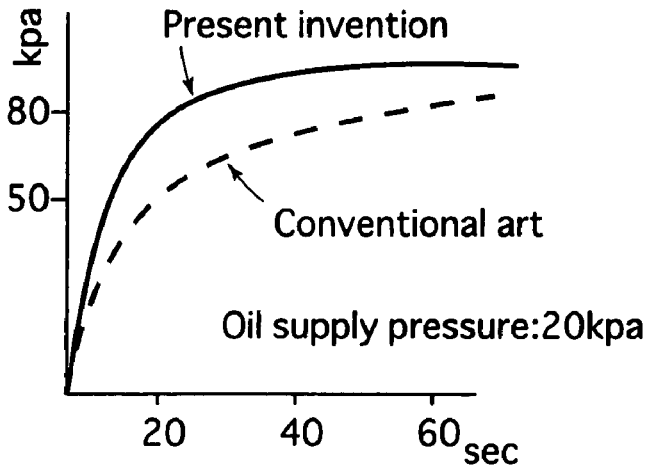
FIG. 4 is a view showing the experiment result.

FIG. 4 shows this with the experimental result. In FIG. 4, an elapsed time from the engine start is shown in the horizontal axis, and an ability to generate the negative pressure in the booster is shown in the longitudinal axis. It may be seen that the vane pump 1 having the configuration of this embodiment denoted by the solid line brings out a predetermined ability to generate the negative pressure more rapidly compared to the vane pump having the conventional configuration denoted by the broken line.

In addition, the oil supply groove 13 may be formed at a position on the side of the exhaust passage 7 relative to the center line L. It is noted that, if the oil supply groove 13 is positioned on the side too much upstream in the rotational direction of the vane 4, the negative pressure to be generated by increasing the volume of the pump room 2A is reduced due to inflow of the lubricating oil. Accordingly, the suction becomes insufficient, and thereby the performance of the vane pump cannot be fully provided.

Further, in this embodiment, the width of the oil supply groove 13 in the rotational direction has been set slightly larger than that of the vane 4. It is noted that, here, if the width of the oil supply groove 13 in the rotational direction is set to be narrower than that of the vane 4, the time for feeding oil is shortened and lubrication cannot be sufficiently performed. On the contrary, if the width of the oil supply groove 13 in the rotational direction is set to be too wide, the amount of the lubricating oil becomes too large and the vane 4 bears a load, when the lubricating oil is removed.

The invention claimed is:

1. A vane pump comprising:

a housing having a pump room, the pump room having an approximately circular inner wall;

a rotor rotating at an eccentric position relative to a center of the pump room and sliding in contact with a part of the inner wall of the pump room; and a vane rotated by the rotor, for dividing the pump room into a plurality of spaces full-time, wherein in the housing, among spaces divided by a center line drawn between the center of the pump room and a center of rotation of the rotor, an intake passage in one space and an exhaust passage in another space are formed, respectively, an oil supply passage intermittently communicating with the pump room owing to the rotation of the rotor is formed in the rotor and the housing, a lubricating oil is intermittently fed through a communicating hole of the oil supply passage formed in the pump room, the communicating hole being formed in a space on a side of the exhaust passage from a center line in the pump room and being formed at a back side from a position at which the exhaust passage is formed, the back side being seen from an upstream side in a rotational direction of the vane, and the vane passes the communicating hole at the same time when the oil supply passage and the pump room are adapted to communicate with each other.

2. The vane pump according to claim 1, wherein a width of the communicating hole in the rotational direction of the vane is not smaller than that of the vane.

3. The vane pump according to claim 1, wherein the rotor comprises a rotor portion for holding the vane and a shank for driving rotationally the rotor portion, in the housing, a bearing for supporting the shank is formed, the oil supply passage comprises an oil passage formed in the shank, the oil passage being open into a sliding surface along the bearing, and an oil supply groove formed on an inner surface of the bearing in an axial direction, for forming the communicating hole in the pump room, and when the oil passage coincides with the oil supply groove due to the rotation of the rotor, the lubricating oil is fed into the pump room.

4. The vane pump according to claim 3, wherein the oil passage comprises a branch passage branching at a required position on the shank in a diametrical direction of the shank, and the vane passes the oil supply groove at the same time when the branch passage and the oil supply groove are adapted to communicate with each other.

5. The vane pump according to claim 3, wherein in the rotor, a groove for holding the vane so that the vane reciprocates is formed in a diametrical direction, and by forming a bottom surface of the groove on a side of the shank from the sliding surface at which the vane slides on the housing, when the oil passage communicates with the oil supply groove, the lubricating oil is arranged to flow into a gap between the bottom surface of the groove and the vane.

* * * * *